US007891343B2

(12) United States Patent
Braun et al.

(10) Patent No.: US 7,891,343 B2
(45) Date of Patent: Feb. 22, 2011

(54) BACKFLOW CONNECTOR AND FUEL INJECTOR HAVING BACKFLOW CONNECTOR

(75) Inventors: Marion Braun, Regensburg (DE); Rainer Venus, Lappersdorf (DE)

(73) Assignee: Continental Automotive GmbH, Hannover (DE)

( * ) Notice: Subject to any disclaimer, the term of this patent is extended or adjusted under 35 U.S.C. 154(b) by 913 days.

(21) Appl. No.: 11/279,491

(22) Filed: Apr. 12, 2006

(65) Prior Publication Data

US 2008/0302430 A1 Dec. 11, 2008

(30) Foreign Application Priority Data

Apr. 12, 2005 (DE) ..... 10 2005 016 865

(51) Int. Cl.
*F02M 55/02* (2006.01)
*F02M 57/02* (2006.01)
*F02M 59/00* (2006.01)

(52) U.S. Cl. ..... 123/469; 239/533.2; 123/446

(58) Field of Classification Search . 239/533.2–533.15; 123/299, 446, 447, 467, 468, 469, 456, 470, 123/472; 285/305, 403, 921, 319; 138/109
See application file for complete search history.

(56) References Cited

U.S. PATENT DOCUMENTS 3,753,582 A * 8/1973 Graham ..... 285/305
5,070,844 A * 12/1991 Daly ..... 123/456
5,092,300 A * 3/1992 Imoehl et al. ..... 123/469
5,146,896 A * 9/1992 Imoehl et al. ..... 123/470
5,979,411 A * 11/1999 Ricco ..... 123/469
7,331,330 B2 * 2/2008 Houy et al. ..... 123/470

FOREIGN PATENT DOCUMENTS

| | | | |
|---|---|---|---|
| DE | 29721023 | U1 | 1/1998 |
| DE | 19900508 | A1 | 7/2000 |
| DE | 19945158 | C1 | 12/2000 |
| EP | 0886065 | A1 | 12/1998 |
| WO | WO9214051 | A1 | 8/1992 |

OTHER PUBLICATIONS

German Office Action, German application No. 10 2005 016 865.5-13, 9 pages, Feb. 20, 2006.

* cited by examiner

*Primary Examiner*—Len Tran
*Assistant Examiner*—Justin Jonaitis
(74) *Attorney, Agent, or Firm*—King & Spalding L.L.P.

(57) ABSTRACT

A fuel injector (10) for injecting fuel into an internal combustion engine has a backflow outlet (18) for taking away the un-injected fuel from the fuel injector (10). A backflow connector (20) is attached to the backflow outlet (18) using a connection component (24), where the connection component (24) is designed so that it can be attached to the backflow nipple (20) in two assembly positions. In the first assembly position the connection component (24) can be pre-assembled on the backflow nipple (20). By moving the connection component (24) into the second assembly position, the backflow nipple (20) can be attached to the fuel injector (10).

16 Claims, 4 Drawing Sheets

BACKFLOW CONNECTOR AND FUEL INJECTOR HAVING BACKFLOW CONNECTOR

CROSS-REFERENCE TO RELATED APPLICATIONS

This application claims priority to German application number 10 2005 016 865.5 filed Apr. 12, 2005, the contents of which are hereby incorporated by reference in their entirety.

TECHNICAL FIELD

The invention relates to a backflow connector for attaching a backflow pipe to a fuel injector, and a fuel injector having such a backflow connector, and a method for attaching a backflow connector to a fuel injector.

BACKGROUND

Common-rail injection systems, which operate with very high injection pressures, are being used increasingly in fuel supply systems of internal combustion engines. In these common-rail injection systems, fuel is pumped by a high-pressure pump into a high-pressure reservoir, from where the fuel is injected into the combustion chamber of the internal combustion engine using fuel injectors. Injection valves are provided for injecting the fuel. These normally have an admission connector, via which the fuel is admitted under pressure. A specified amount of fuel, controlled by a control device, is injected into a cylinder of an internal combustion engine. The high injection pressure means that not all of the admitted fuel is injected into the cylinder. Hence the excess fuel that is not injected must be taken away from the injection valve. This is normally done via a backflow connector on the injection valve.

The backflow connector on the fuel injector generally also has a connector nipple on which the backflow pipe is mounted. In order to prevent the connector nipple being forced out by the fuel flowing out of the fuel injector, the connector nipple must be secured on the fuel injector. EP 0886065A1, for example, discloses such a backflow connector for attaching a backflow pipe to a fuel injector. This backflow connector, also called backflow nipple below because of its preferred shape, includes a U-shaped fastener whose arms are undulatory in shape, where the fastener can be inserted into lateral slots on an end connector element. It thereby engages in a securing position in an annular groove on an insert of a connector nipple, which is inserted into the end connector element.

DE 19900508C2 describes a backflow connector for attaching a backflow pipe to a fuel injector, which has an end connector element that is constructed as a single piece with the injector body. A connector nipple engages by its insert in a hole in the end connector element. An axial securing device in the form of a pre-tensioned clip having a recess on each arm in the end connector element is arranged substantially at right angles to the connector nipple.

It is essential to ensure that no mistakes are made when fitting the end connector element and the securing element.

SUMMARY

A backflow connector can be designed, for which it is possible to recognize, in particular visually, when it is fitted correctly.

According to an embodiment, a backflow connector for attaching to a backflow outlet of a fuel injector, from which un-injected fuel can be taken away from the fuel injector, may have a connection component for connecting the backflow connector to the fuel injector, wherein the connection component is designed to be attached to the backflow connector in a first and a second assembly position.

According to a further embodiment, the connection component may have a securing element for securing the connection part to the fuel injector. According to a further embodiment, the securing element can be designed as a pin-like area. According to a further embodiment, the backflow connector may have a groove into which the connection component engages in its first or second assembly position. According to a further embodiment, the connection component may have a first cavity, for attachment in the groove of the backflow connector, and may have a second cavity, for attachment in the groove of the backflow connector, where the connection component can be moved in the groove of the backflow connector from the first cavity into the second cavity. According to a further embodiment, the pin-like area on the connection component may be designed so that it engages in a cavity, in particular a hole, of the injector on attaching the connection part to the backflow connector in its second assembly position. According to a further embodiment, the backflow connector can be shaped as a backflow nipple.

According to another embodiment, a fuel injector for injecting fuel into an internal combustion engine may comprise a high-pressure connector for receiving the fuel under high pressure, a pressure pipe connection which is connected to the high-pressure connector and connects the high-pressure connector to a fuel admission, and a backflow outlet for taking away un-injected fuel from the fuel injector, wherein a backflow connector is provided on the backflow outlet, and wherein a connection component is provided to connect the backflow connector to the backflow outlet, said connection component being designed to assume a first and a second assembly position on the backflow connector, and is attached to the backflow outlet in the second assembly position.

According to a further embodiment, the connection component may have a pin-type area, which, in the second assembly position, extends into a hole made in the fuel injector. According to a further embodiment, the backflow connector can be shaped as a backflow nipple.

According to yet another embodiment, a method for fitting a backflow connector to a fuel injector, may comprise the steps of: pre-assembling a connection component on a backflow connector in a first assembly position on a groove of an assembly nipple, attaching the assembly nipple together with the connection component to a backflow outlet of the fuel injector and then moving the connection component into a second assembly position so that a securing element provided on the connection component engages in a mating part on the fuel injector.

According to a further embodiment, the securing element may be designed as a pin-like area of the connection component, and the pin-like area is inserted in a hole in the fuel injector on moving into the second assembly position.

BRIEF DESCRIPTION OF THE DRAWINGS

Further advantages and embodiments are the object of the figures below and their descriptive passages, in which.

DETAILED DESCRIPTION

According to various embodiments, a connection component for connecting the backflow connector to the fuel injector is thus provided on the backflow connector for attaching to a backflow outlet of a fuel injector. The connection component is designed so that it can be attached to the backflow connector in a first and a second assembly position. It preferably may have a securing element for securing the connection part to the fuel injector, where the securing element may be designed as a pin-like area for example.

In an embodiment, the backflow connector has a groove into which the connection component engages in its first or second assembly position. In particular, the pin-like area can engage in a cavity, in particular a hole, of the injector on attaching the connection part to the backflow connector in its second assembly position.

A fuel injector for injecting fuel into an internal combustion engine can thus be provided that has a backflow connector according to various embodiments.

The existence of a component that is simple and cheap to manufacture and takes little effort to fit is then guaranteed by the backflow connector and fuel injector according to various embodiments. Furthermore, the backflow connector for fitting to the fuel injector can be supplied as a pre-assembled component.

In the method for fitting, the assembly nipple is supplied ready assembled with the connection component, so that it can be attached easily to the backflow outlet of the fuel injector. The connection component is then moved into a second assembly position so that a securing element provided on the connection component engages in a mating part on the fuel injector. This ensures that a secure connection can be made despite simple fitting. Furthermore, the component can also be removed easily and can hence be re-used. Incorrect fitting can be recognized by a simple visual check of the assembly position and corrected if necessary. Potential sources of mistakes during fitting are thereby reduced.

Figure 1:
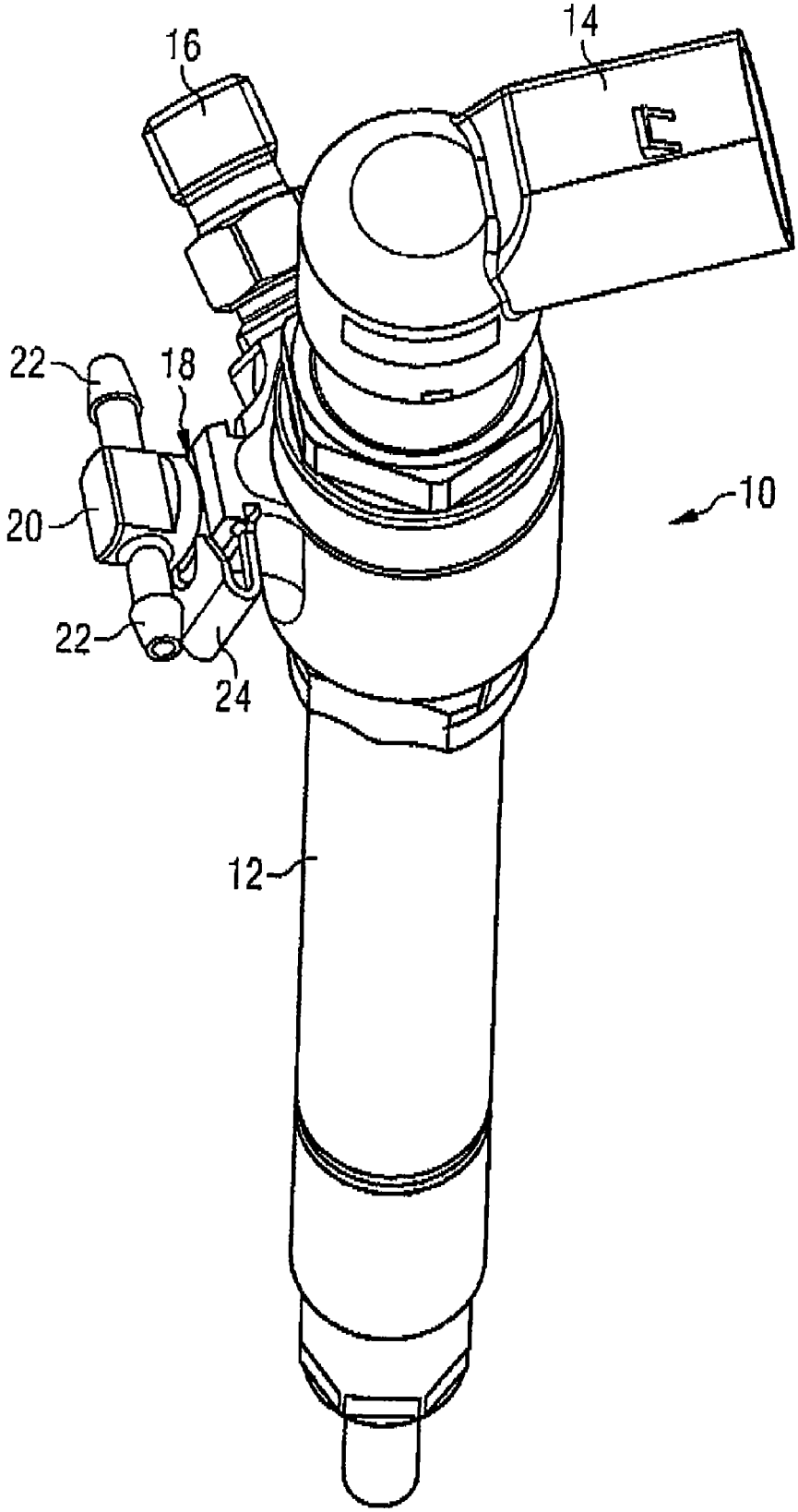
FIG. 1 shows a view of the fuel injector according to an embodiment.

FIG. 1 shows a fuel injector 10 having a body 12 and an electrical connection 14 via which the fuel injector can be controlled. The fuel is admitted via a pressure pipe connection 16, but not entirely injected into the cylinder. At the end of the injection process, the quantity of fuel not injected must therefore be taken away from the fuel injector 10. This is done via the backflow outlet 18, into which a backflow connector 20 is inserted. The backflow connector has two pipe connections 22 for attaching fuel return pipes. In order to ensure easy fitting of the return pipes, it must be possible to attach the backflow connector 20 to the backflow outlet 18 so that it can rotate. To connect the backflow nipple 20 to the fuel injector 12, a connection component 24 is provided according to the invention, which can be attached to the backflow connector 20 in a first assembly position called the pre-assembly position, and in a second assembly position called the fixing position.

Figure 2:
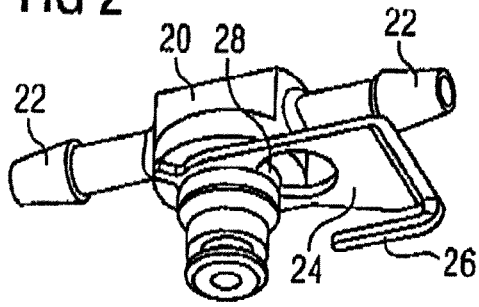
FIG. 2 shows a backflow connector according to an embodiment having a connection component.

FIG. 2 shows the assembly connector 20 on which the connection component 24 is pre-assembled in the first assembly position. As shown in FIG. 2, it may be pre-assembled by the connection component 24 being inserted into a groove 28 of the backflow connector, for example. The connection component 24 has a securing element, for example in the form of a securing pin 26, for securing the assembly connector to the fuel injector 10.

Figure 3A:
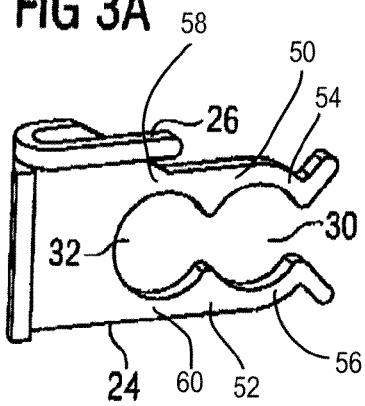
FIG. 3*a*-3*d* show a connection component and its assembly positions.
Figure 3B:
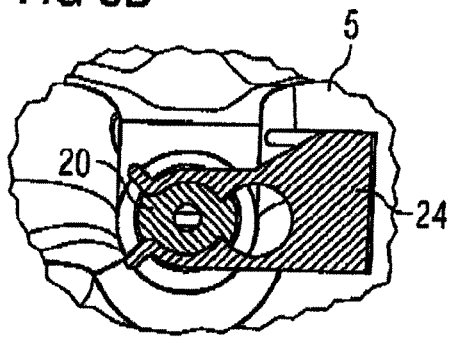
Figure 3C:
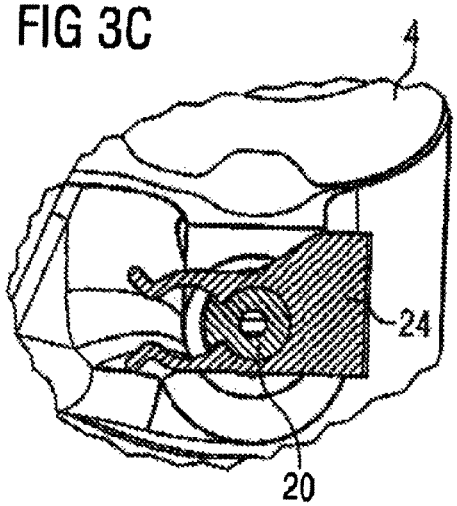
Figure 3D:
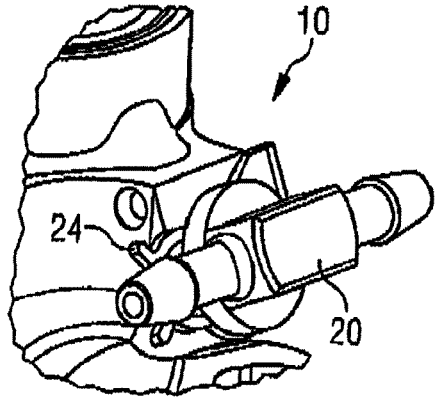

FIG. 3*a* shows the connection component 24 as a separate part. The connection component 24 includes arms 50 and 52. A first cavity 30 is defined between first arm portions 54 and 56 of arms 50 and 52, and a second cavity 32 is defined between second arm portions 58 and 60 of arms 50 and 52. The connection component 24 can be attached to the backflow connector 20 by the first arm portions 54 and 56 in the first, or pre-assembly, position. This pre-assembly position of the connection component 24 on the backflow connector 20 is shown in FIG. 3*b*, where the first arm portions 54 and 56 engage in a groove 28 of the assembly connector. Using this design it is possible to supply the connection component 24 ready assembled on the assembly nipple 20, so that this is immediately available for mounting onto the fuel injector 10. To fit, the backflow connector 20 with the pre-assembled connection component 24 is inserted in the backflow connector 22, and then the connection component 24 is moved so that it encloses the backflow connector 20 in the second assembly position, or fixing position as it is called, with the second arm portions 58 and 60 of the connection component 24 engaging in the groove 28 of the backflow connector 20. The backflow connector is thereby fixed to the fuel injector 10 at the backflow outlet 18. The securing pin 26, which as illustrated is connected to, but separate from, arms 50 and 52, is inserted into a hole in the fuel injector 10 on sliding the connection component 24 into the fixing position, so that an accidental release of the connection element 24 can be prevented. For this purpose, undercuts are made in the backflow connector area that prevent this. By comparing FIGS. 3*c* and 3*b* it is immediately obvious that it is easy to check visually each of the required positions of the connection component 24, because this is very easy to recognize. The backflow connector 20 fitted on the fuel injector 10 is shown again in FIG. 3*d* in perspective view. Here the fixing position of the connection component 24 can also be recognized clearly.

Figure 4A:
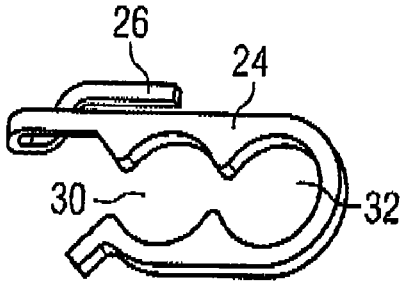
FIG. 4 shows a further embodiment of a connection component and its assembly positions.
Figure 4B:
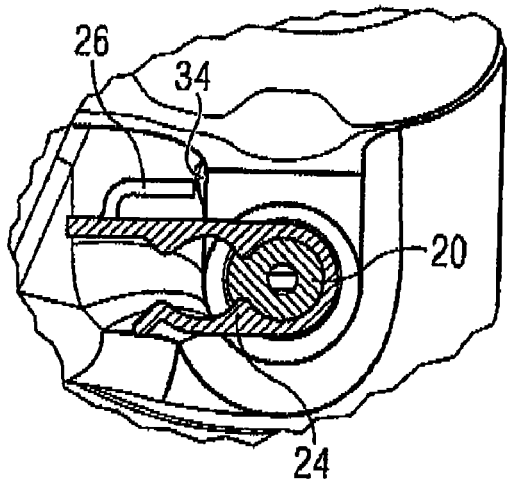

An alternative embodiment of the connection component 24 is shown in FIG. 4*a*. The connection component 24 again has a first cavity 30 and a second cavity 32. Once again, a securing pin 26 is also provided, which acts as a securing element for securing the connection component 24. FIG. 4*b* shows the first pre-assembly position of the connection component 24 on the backflow connector 20. In this embodiment, in the first pre-assembly position, the second cavity 32 encloses a groove 28 made in the backflow connector, while the first cavity 30 is vacant. The securing pin 26 still lies outside the hole 34.

Figure 4C:
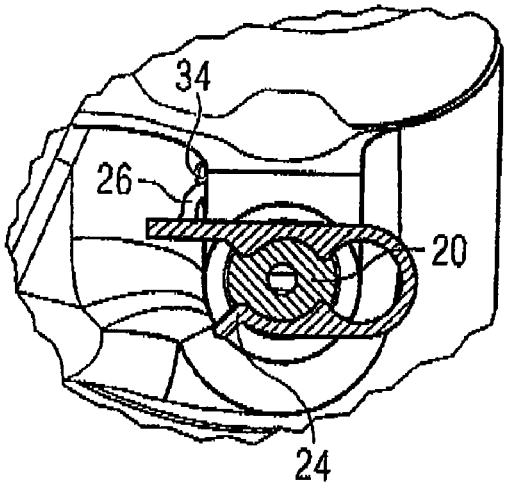
Figure 4D:
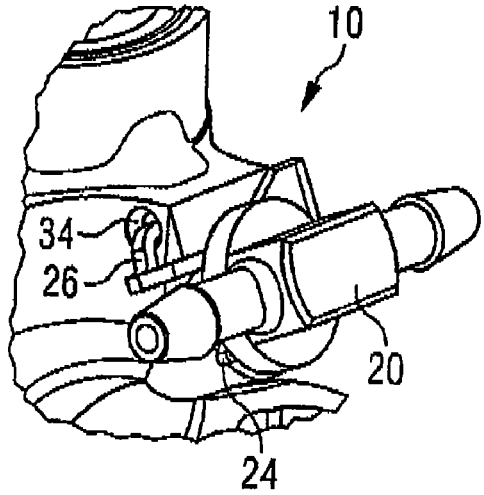

FIG. 4*c* shows the connection component 34 in its fixing position on the assembly nipple 20. The cavity 30 now encloses a groove made in the backflow connector 20, while the cavity 32 is vacant. The securing pin 26 is inserted in a hole 34. The conditions of the "closed" position are shown again in FIG. 4*d* in perspective view. The assembly nipple 20 is attached to the fuel injector 10 using the connection component. The connection component is in its fixing position, with the securing pin 26 inserted in the hole 34 of the fuel injector 10.

Figure 5A:
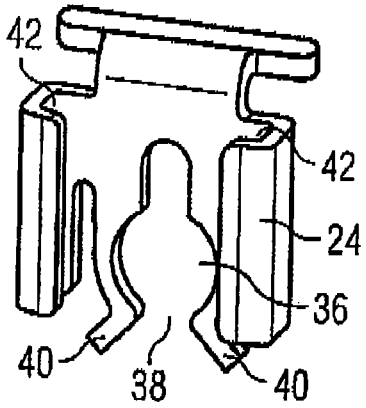
FIG. 5 shows an alternative embodiment of the connection component and its assembly positions.
Figure 5B:
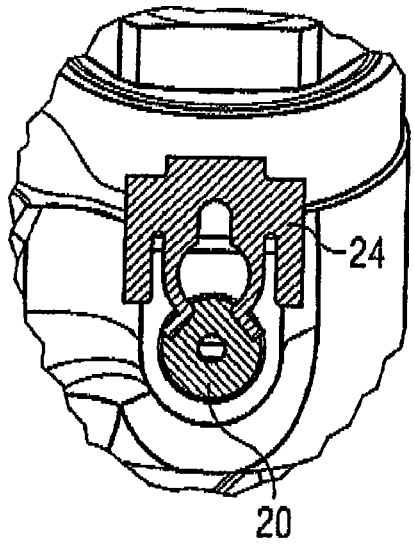
Figure 5C:
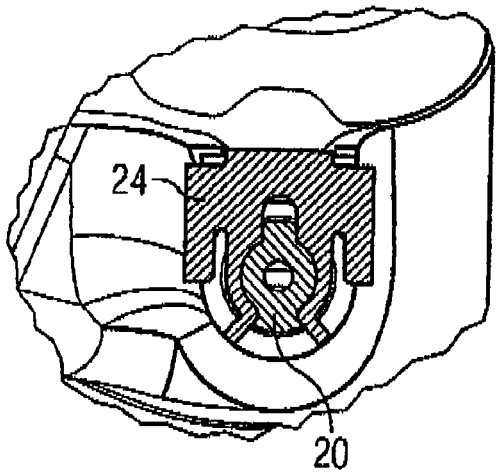
Figure 5D:
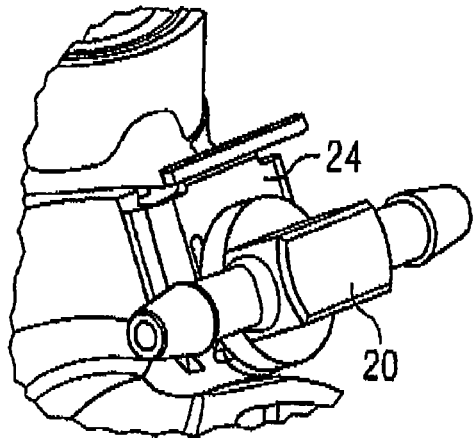

A further embodiment of the connection component 24 is shown in FIG. 5*a*. Here the connection component 24 has a cavity 36 and an aperture region 38 shaped like a clamp. These are formed by clamp areas 40. As evident from FIG. 5*b*, to pre-assemble on the backflow connector 20, the clamp areas 40 are inserted into two grooves made in the backflow ledge, the connection component 24 thereby finding sufficient purchase against slipping. To fit, the connection component 24 is installed from below and pushed upwards until the backflow hole is exposed again. After fitting the backflow connector, the connection component, which may be preferably bent from sheet metal, is pushed downwards again, thereby engaging in a groove in the backflow connector. At the same time, the guides 42 provide a purchase for the connection component 24 on the fuel injector 10, as can be seen in FIG. 5*c* and in the perspective view of 5*d*.

The connection components of the embodiments described above may be preferably made of sheet metal. Nevertheless, other materials, in particular plastics, are also suitable as a material for the connection components.

The backflow connector according to various embodiments having the connection component 24 enables simple and cheap fitting, requiring little effort to be made on the parts to be joined. Furthermore, the backflow connector having the connection component can be supplied pre-assembled, which further reduces the effort for fitting the fuel injector 10. In addition, a visual check is possible, which can be used to determine easily whether the connecting element is secured. Furthermore, it is possible to remove the component easily and re-use the backflow connector and/or the securing element if applicable.

What is claimed is:

1. A backflow connector for attaching to a backflow outlet of a fuel injector, from which un-injected fuel can be taken away from the fuel injector, comprising a connection component for connecting the backflow connector to the fuel injector, wherein the connection component includes:

a first arm including first and second arm portions, a second arm including first and second arm portions, a first positioning structure including the first arm portions of the both the first and second arms, a second positioning structure including the second arm portions of the both the first and second arms, and a securing element connected to, but spaced apart from both the first and second arms, and wherein the connection component is designed to be attached to the backflow connector in:

(a) a first assembly position in which the first positioning structure is engaged with the backflow connector to form a pre-assembly of the connection component and the backflow connector that is not secured to the fuel injector, and (b) a second assembly position in which the second positioning structure is engaged with the backflow connector and the securing element, spaced apart from both the first and second arms of the connection component, is engaged with a corresponding structure of the fuel injector to secure the pre-assembly of the connection component and the backflow connector to the fuel injector.

2. The backflow connector according to claim 1, wherein the securing element is designed with a pin-like area.

3. The backflow connector according to claim 1, wherein the backflow connector has a groove into which the connection component engages in the first and second assembly positions.

4. The backflow connector according to claim 3, wherein:

in the first assembly position, the first positioning structure of the connection component is received in the groove of the backflow connector, in the second assembly position, the second positioning structure of the connection component is received in the groove of the backflow connector, and the connection component can be moved along the groove of the backflow connector from the first assembly position to the second assembly position.

5. The backflow connector according to claim 2, wherein the pin-like area on the connection component is designed so that it engages in a cavity of the fuel injector on attaching the connection part to the backflow connector in its second assembly position.

6. The backflow connector according to claim 1, wherein the backflow connector is shaped as a backflow nipple.

7. A fuel injector for injecting fuel into an internal combustion engine comprising a high-pressure connector for receiving the fuel under high pressure, and a backflow outlet for taking away un-injected fuel from the fuel injector, wherein a backflow connector is provided on the backflow outlet, and wherein a connection component is provided to connect the backflow connector to the backflow outlet, said connection component including:

a first arm including first and second arm portions, a second arm including first and second arm portions, a first positioning structure including the first arm portions of the both the first and second arms, a second positioning structure including the second arm portions of the both the first and second arms, and a securing element connected to, but spaced apart from both the first and second arms, wherein said connection component is designed to be attached to the backflow connector in:

(a) a first assembly position in which the first positioning structure is engaged with the backflow connector to form a pre-assembly of the connection component and the backflow connector that is not secured to the fuel injector, and (b) a second assembly position in which the second positioning structure is engaged with the backflow connector and the securing element, spaced apart from both the first and second arms of the connection component, is engaged with a corresponding structure of the fuel injector to secure the pre-assembly of the connection component and the backflow connector to the fuel injector.

8. The fuel injector according to claim 7, wherein the connection component has a pin-like area, which, in the second assembly position, extends into a hole made in the fuel injector.

9. The fuel injector according to claim 7, wherein the backflow connector is shaped as a backflow nipple.

10. A method for fitting a backflow connector to a fuel injector using a connection component including a first arm including first and second arm portions, a second arm including first and second arm portions, a first positioning structure including the first arm portions of both the first and second arms, a second positioning structure including the second arm portions of both the first and second arms, and a securing element connected to, but spaced apart from both the first and second arms, the method comprising the steps of:

pre-assembling a connection component on a backflow connector in a first assembly position in which the first positioning structure engages with a groove of the backflow connector to form a pre-assembly of the connection component and the backflow connector that is prior to attaching the connection component/backflow connector assembly to a backflow outlet of the fuel injector, and attaching the pre-assembly of the connection component and the backflow connector to the backflow outlet of the fuel injector and then moving the connection component into a second assembly position in which the second positioning structure engages with the groove of the backflow connector assembly so that the securing element, spaced apart from both the first and second arms of the connection component, engages in a mating part on the fuel injector.

11. The method according to claim 10, wherein the securing element is designed as a pin-like area of the connection component, and the pin-like area is inserted in a hole in the fuel injector on moving the connection component into the second assembly position.

12. The fuel injector according to claim 7 wherein the securing element is designed with a pin-like area.

13. The fuel injector according to claim 7, wherein the backflow connector has a groove into which the connection component engages in the first and second assembly positions.

14. The fuel injector according to claim 7, wherein:

in the first assembly position, the first positioning structure of the connection component is received in the groove of the backflow connector, and in the second assembly position, the second positioning structure of the connection component is received in the groove of the backflow connector, and the connection component can be moved along the groove of the backflow connector from the first assembly position to the second assembly position.

15. The fuel injector according to claim 12, wherein the pin-like area on the connection component engages in a cavity of the fuel injector upon moving the connection component into the second assembly position.

16. The backflow connector according to claim 1, wherein in the second assembly position in which the securing element is engaged with the corresponding structure of the fuel injector, neither the first positioning structure nor the second positioning structure are engaged with the fuel injector.

* * * * *